US008668048B1

(12) United States Patent
Morris

(10) Patent No.: US 8,668,048 B1
(45) Date of Patent: Mar. 11, 2014

(54) ELEVATOR ASSEMBLY FOR ACCESSING AN ELEVATED PLATFORM OF A COMBINE

(71) Applicant: Glen H. Morris, Mound City, MO (US)

(72) Inventor: Glen H. Morris, Mound City, MO (US)

( * ) Notice: Subject to any disclaimer, the term of this patent is extended or adjusted under 35 U.S.C. 154(b) by 0 days.

(21) Appl. No.: 13/662,746

(22) Filed: Oct. 29, 2012

(51) Int. Cl.
*E06C 5/00* (2006.01)

(52) U.S. Cl.
USPC ..... 182/127; 182/85

(58) Field of Classification Search
USPC ..... 414/540, 631, 663; 182/127, 85; 280/4, 280/163, 166
See application file for complete search history.

(56) References Cited

U.S. PATENT DOCUMENTS 1,146,559 A * 7/1915 Fuller ..... 105/437
2,967,584 A 8/1957 Westerlund
3,869,022 A * 3/1975 Wallk ..... 182/96
4,131,293 A 12/1978 Kindle
4,161,997 A * 7/1979 Norman ..... 182/93
4,245,716 A 1/1981 Rayfield
5,064,022 A 11/1991 Graham
5,339,919 A 8/1994 Boyd
8,113,315 B2 2/2012 Farley et al.
2003/0221908 A1 * 12/2003 Fix ..... 182/127

* cited by examiner

*Primary Examiner* — Stephen Vu

(74) *Attorney, Agent, or Firm* — Dennis L. Thomte; Thomte Patent Law Office LLC

(57) ABSTRACT

A personnel elevator assembly is provided to enable a person to gain access to the elevated platform of a combine with the combine having a ladder assembly extending downwardly from the platform. The elevator assembly is secured to and is supported by the ladder assembly and includes an elevator step which is movable from a position close to the ground to a position thereabove so as to be at approximately the same level as the platform.

12 Claims, 7 Drawing Sheets

ELEVATOR ASSEMBLY FOR ACCESSING AN ELEVATED PLATFORM OF A COMBINE

BACKGROUND OF THE INVENTION

1. Field of the Invention

This invention relates to a personnel elevator assembly for a combine and more particularly to a personnel elevator assembly which is attached to the ladder frame of the combine to enable a person to be elevated from ground level to the elevated platform of a combine and lowered from the elevated platform to the ground.

2. Description of the Related Art

All modern self-propelled combines include an elevated platform upon which the operator's seat or cab is positioned. Access is gained to the elevated platform by a vertically disposed or a generally vertically disposed ladder having vertically spaced steps provided thereon. In most cases, the lowermost step of the ladder is spaced above the ground approximately 12-18 inches. The operator of the combine who wishes to move up to the operator's seat or cab must step up to the lowermost step of the ladder and then climb upwardly on the ladder until the platform is reached.

Many farmers, especially those elderly farmers who have knee, hip, leg or back problems, or those younger farmers who have experienced knee, hip, leg or back injuries have a difficult time in not only stepping up to the lowermost step of the combine ladder but also have difficulty in climbing the remaining steps of the ladder. Those persons also have difficulty in descending from the platform to the ground.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

All combines have a ladder provided thereon for accessing the elevated platform of the combine. The personnel elevator assembly of this invention includes a first substantially vertically disposed side frame having an inner side, an outer side, an upper end and a lower end and a second substantially vertically disposed side frame having an inner end, an outer end, an upper end and a lower end. The first and second side frames are horizontally spaced-apart from one another. The first and second side frames are secured to the ladder of the combine by a supporting framework so as to position the first and second side frames laterally outwardly from the outer side of the combine ladder. A first substantially vertically disposed step support member, having upper and lower ends, is vertically movably mounted on the first side frame. A second substantially vertically disposed step support member, having upper and lower ends, is vertically movably mounted on the second side frame. The first and second step support members are interconnected so that they vertically move together in unison. The first and second step support members are movable between a lower position and an upper position.

A horizontally disposed elevator step is secured to and extends between the lower ends of the first and second step support members for vertical movement therewith. The horizontally disposed elevator step, which extends between lower ends of the first and second step support members, is positioned below the lower end of the combine ladder and outwardly therefrom adjacent the ground when the first and second step support members are in the lower position. The horizontally disposed elevator step on the lower ends of the step support members is positioned at approximately the same level as the elevated combine platform when the first and second step support members are in the upper position.

Means is also provided for moving the first and second step support members between the lower and upper positions and for moving the first and second support members between the upper and lower positions. In the preferred embodiment, the means for moving the first and second step support members comprises a winch which is mounted on the upper end of the second side frame with the winch having a winch cable extending therefrom which is operatively connected to the first and second step support members to move the first and second step support members between their lower and upper positions and their lower and upper positions.

A principal object of the invention is to provide a personnel elevator assembly to permit a person to access the elevated platform of a combine.

A further object of the invention is to provide a personnel elevator assembly for accessing the elevated platform of a combine which comprises an elevator assembly which is operatively secured to and supported by the ladder of the combine which includes a vertically movable personnel supporting step upon which the operator may step.

A further object of the invention is to provide a personnel elevator assembly of the type described which enables a person having hip, knee, leg or back problems to gain access to the platform of a combine and to enable the same person to be lowered from the elevated platform to the ground.

A further object of the invention is to provide an elevator assembly of the type described which is easily attached to the ladder of an existing combine.

A further object of the invention is to provide an elevator assembly of the type described which is convenient and safe to use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
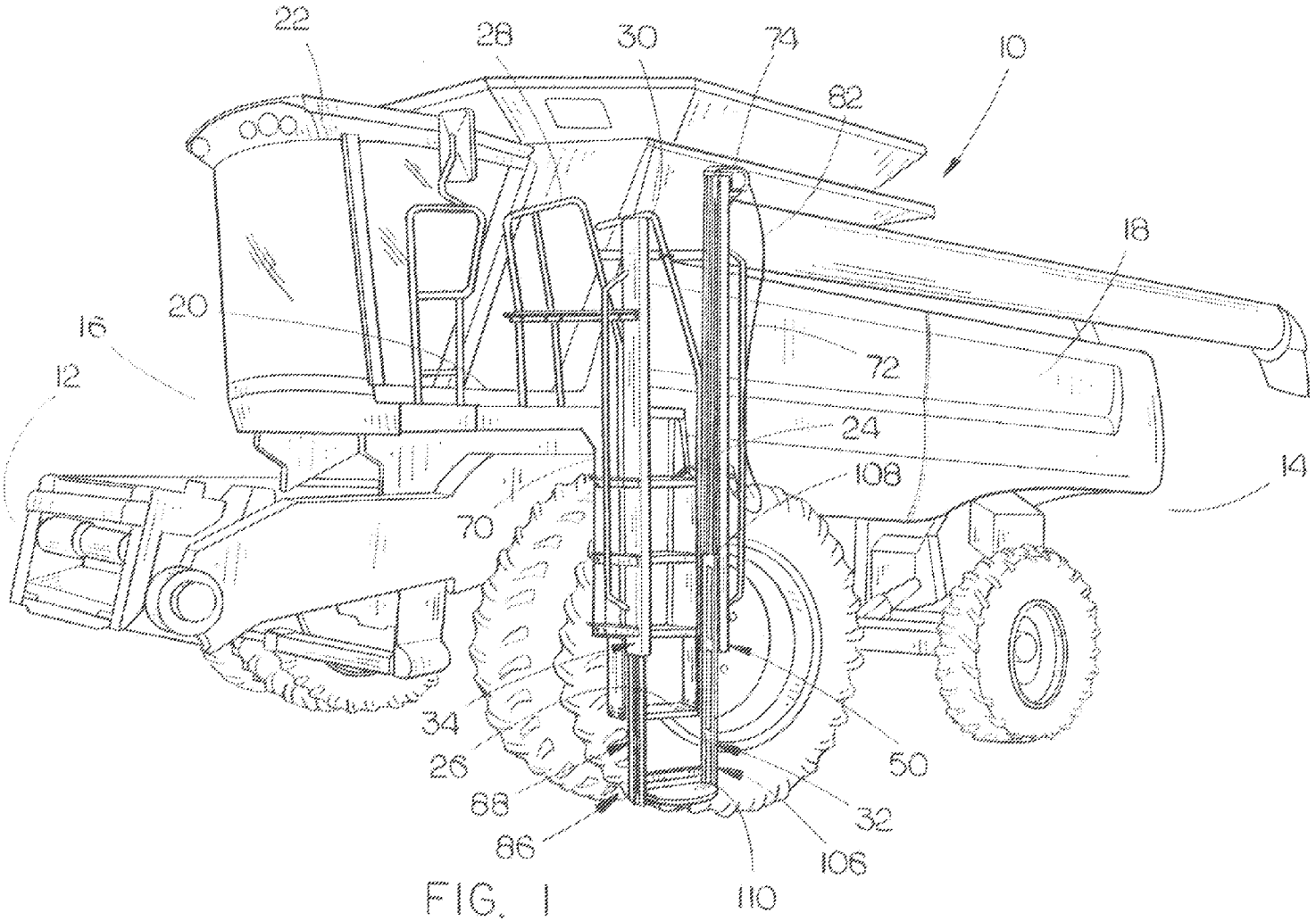
FIG. 1 is a front perspective view of a combine having the elevator assembly of this invention mounted thereon.

Embodiments are described more fully below with reference to the accompanying figures, which form a part hereof and show, by way of illustration, specific exemplary embodiments. These embodiments are disclosed in sufficient detail to enable those skilled in the at to practice the invention. However, embodiments may be implemented in many different forms and should not be construed as being limited to the embodiments set forth herein. The following detailed description is, therefore, not to be taken in a limiting sense in that the scope of the present in is defined only by the appended claims.

The numeral 10 refers to a combine such as that manufactured by Deere and Company. Combine 10 includes a forward end 12, a rearward end 14, a right side 16 and a left side 18. Combine 10 also includes an elevated platform 20 upon which is usually mounted an operator's cab 22 or an operator's seat. The combine 10 includes a ladder assembly 24 which is positioned at side 18 of the combine and which extends downwardly from the platform 20 towards the ground. The upper end of the ladder assembly 24 is usually in the same plane as the platform 20. Ladder assembly 24 includes a ladder frame 25 having a plurality of vertically spaced-apart steps 26 positioned thereon with the lowermost step thereof being usually positioned above the ground approximately 12-18 inches. A railing 28 is mounted on the upper end of the ladder assembly 24 of the combine at the forward upper end of ladder assembly 24. A railing 30 is mounted on the upper end of the ladder assembly 24 of the combine at the upper rearward end of the ladder assembly 24. It is to this structure that the instant invention is attached to enable a person having leg, knee, hip or back problems to be able to gain access to the elevated platform 20 and to be able to descend from the platform 20 to the ground.

Figure 5:
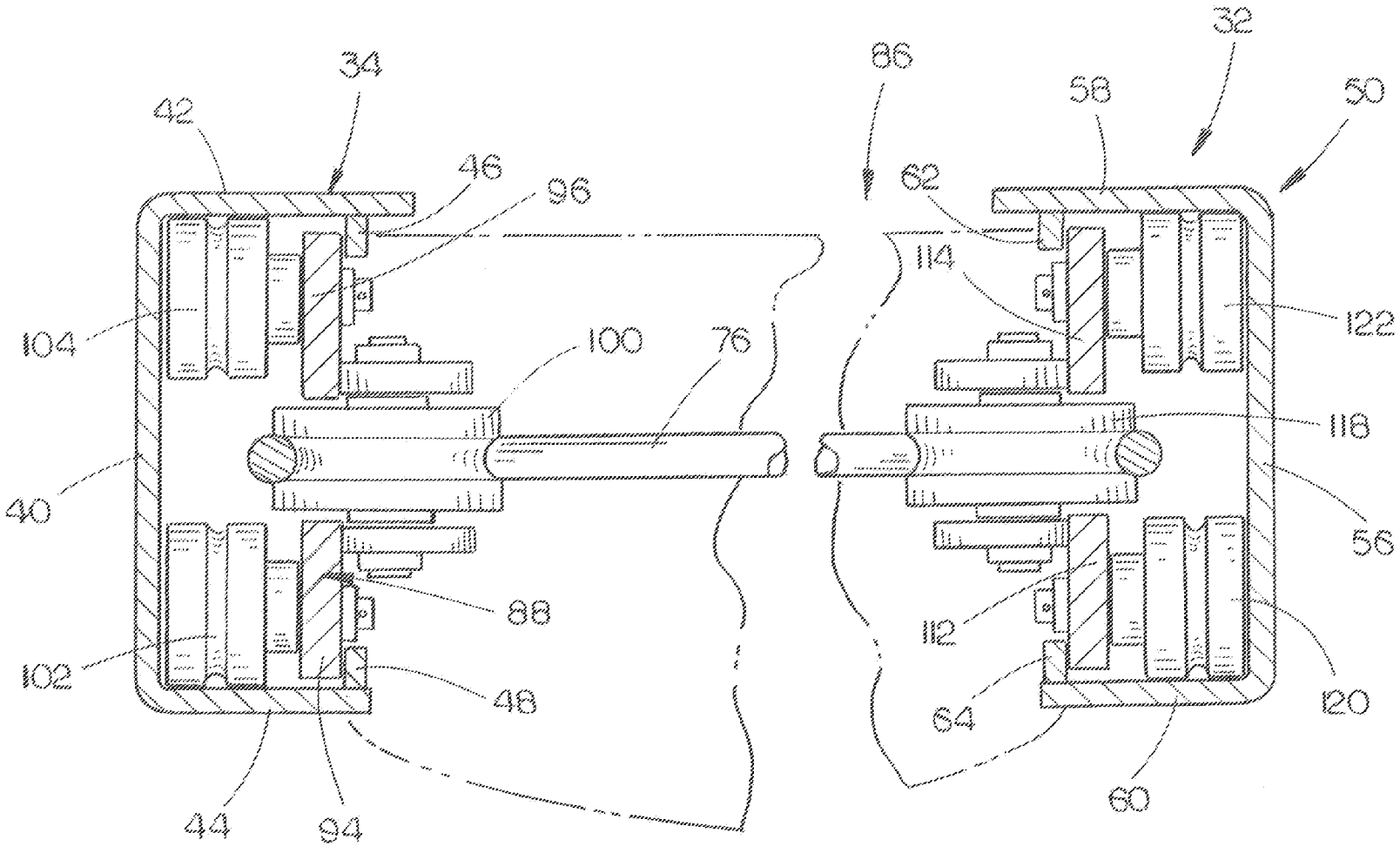
FIG. 5 is a sectional view of a portion of the elevator assembly of his invention.
Figure 6:
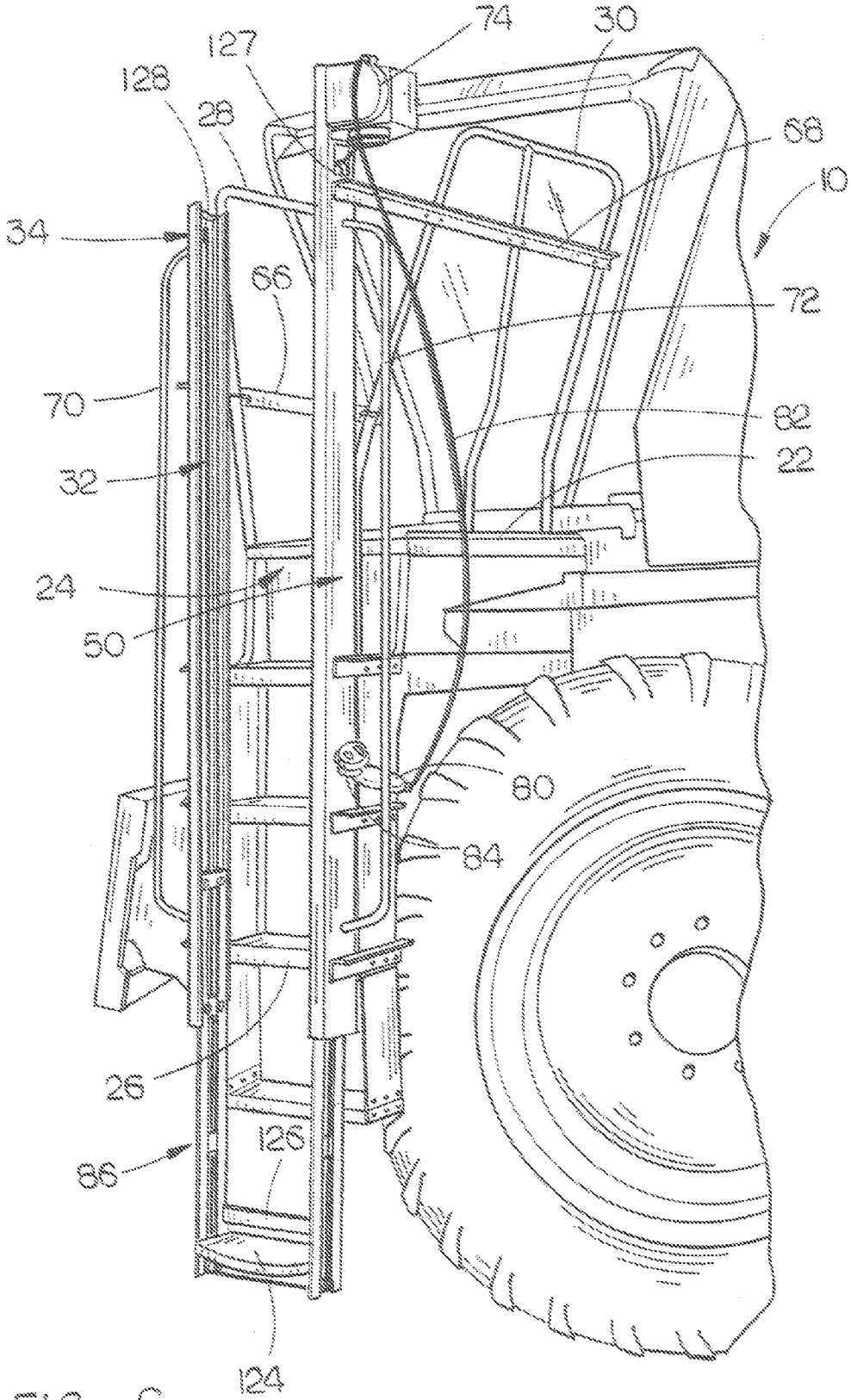
FIG. 6 is a partial perspective view illustrating the elevator assembly of his invention in a lower position.
Figure 7:
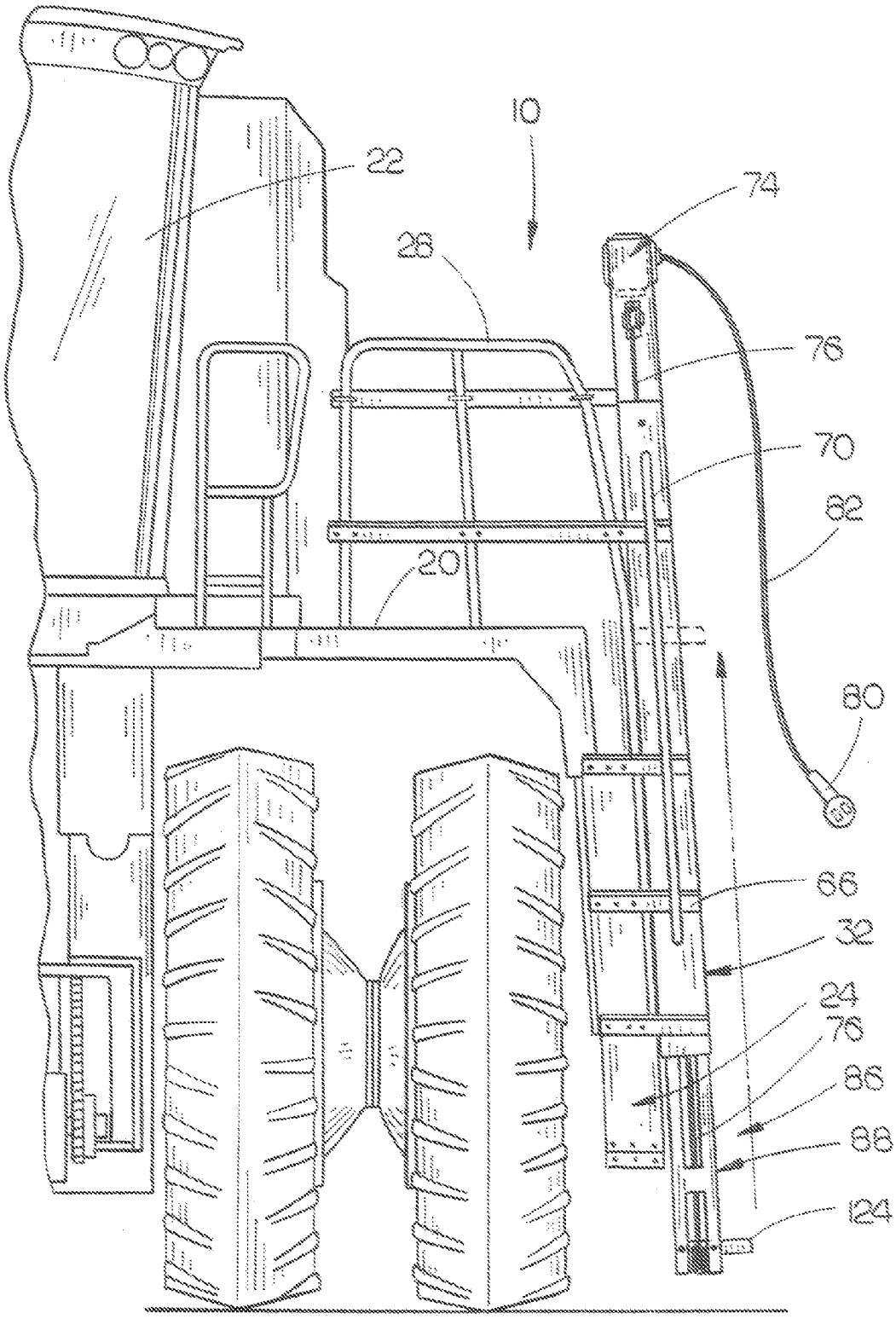
FIG. 7 is a front view of the elevator assembly of this invention which illustrates the elevator being raised from the ground.

The numeral 32 refers to the personnel elevator assembly of this invention which enables a person to easily gain access to the platform 20 and/or the operator's cab 22. The elevator assembly 32 includes a first upstanding and generally vertically disposed side frame 34 having an upper end 36 and a lower end 38. As seen in FIG. 5, side frame 34 is channel-shaped and includes a web portion 40 and side flanges 42 and 44. Although web portion 40 and side flanges 42 and 44 are shown as being of one-piece construction, they could be separate pieces welded together. The inner side of flange 42 has an elongated flat bar welded thereto which extends therefrom. The inner side of the flange 44 has an elongated flat bar 48 welded thereto which extends therefrom.

Elevator assembly 32 also includes a second upstanding and generally vertically disposed side frame 50 having an upper end 52 and a lower end 54. As seen in FIG. 5, side frame 50 is channel-shaped and includes a web portion 56 and side flanges 58 and 60. Although web portion 56 and flanges 58 and 60 are shown as being of one-piece construction, they could be separate pieces welded together. The inner side of flange 58 has an elongated flat bar 62 welded thereto which extends therefrom. The inner side of flange 60 has an elongated flat bar 64 welded thereto which extends therefrom.

Side frame 34 is secured to the ladder frame 25 or to the combine or to the railings by a plurality of braces 66. Side frame 50 is secured to the ladder frame 25 or to the combine or to the railings at the upper end of the side frame by a plurality of braces 68. As seen in the drawings, side frames 34 and 50 are spaced outwardly of the ladder assembly 24.

A railing 70 is secured to the forward side of side frame 34. A railing 72 is secured to the rearward side of side frame 50. A reversible electric winch 74 is secured to the upper end of side frame 50 and has a winch cable 76 extending therefrom. Winch 24 is electrically connected to the combine electrical system by an electrical cable or conduit 78. A controller 80 for the winch 74 is provided with the controller 80 being connected to the winch 74 by a flexible cable or conduit 82. The controller 80 may be stowed in the receptacle 84 secured to side frame 50.

Figure 2:
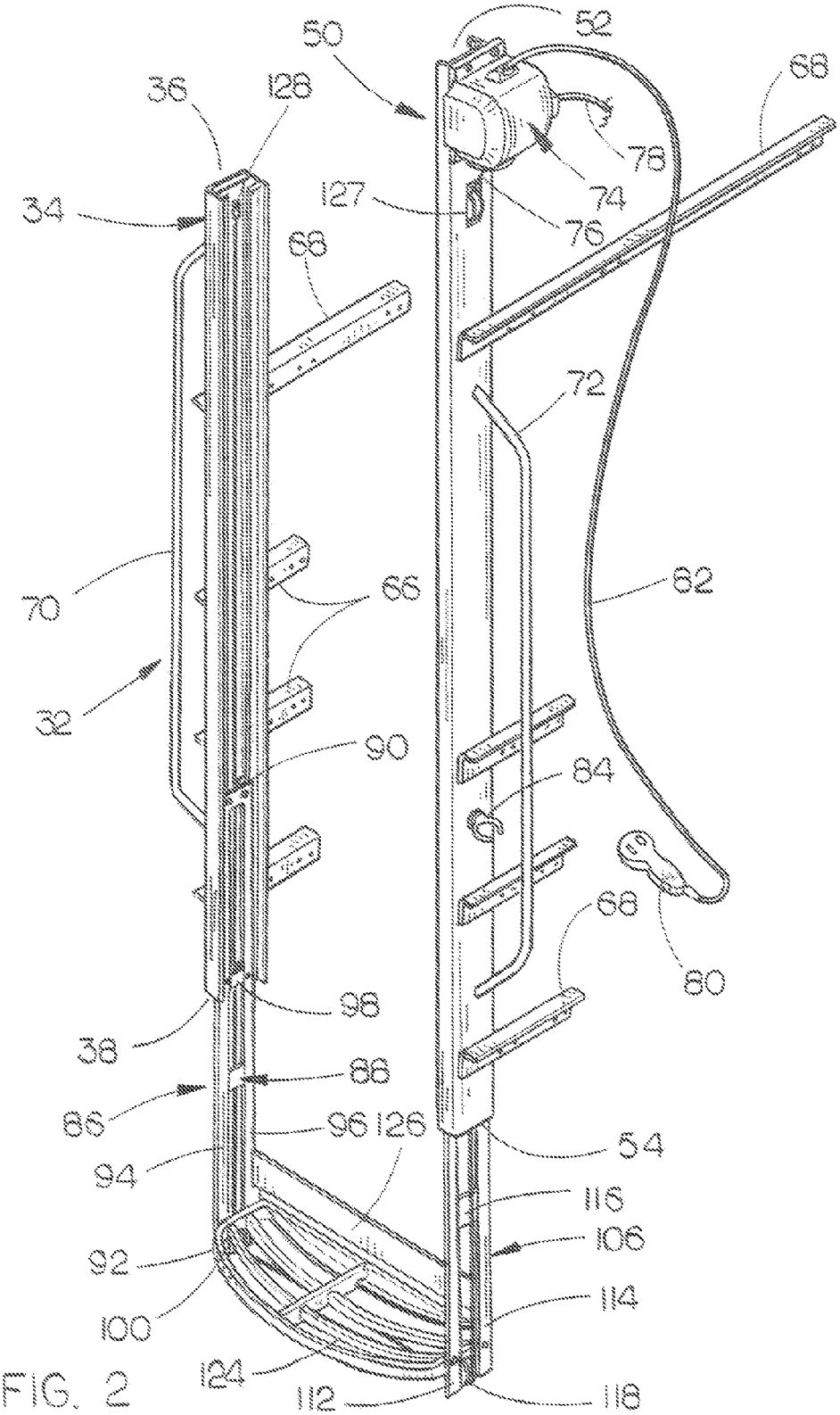
FIG. 2 is a perspective view of the elevator assembly of this invention.
Figure 3:
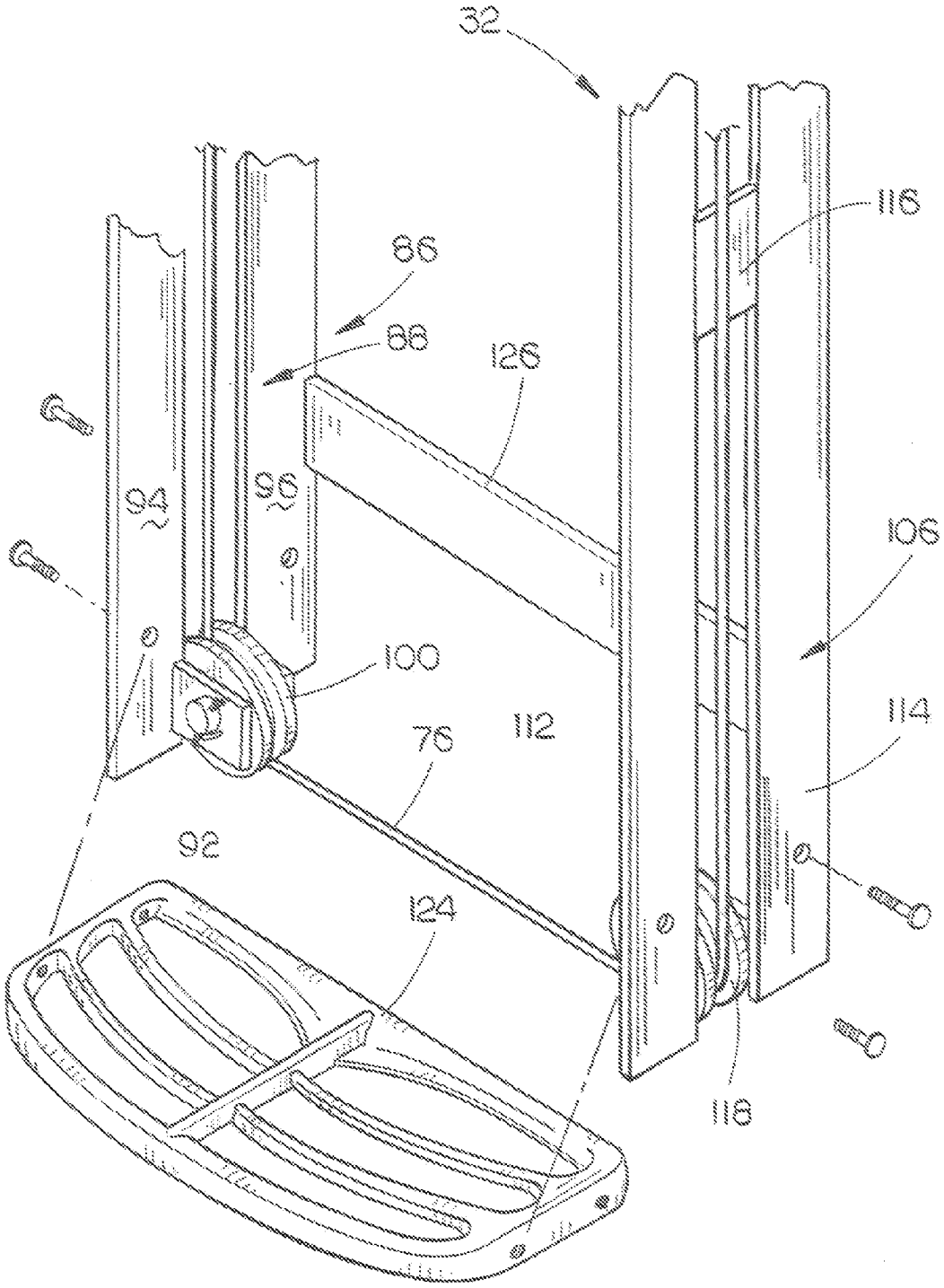
FIG. 3 is a partial exploded perspective view of the elevator assembly of this invention.
Figure 4:
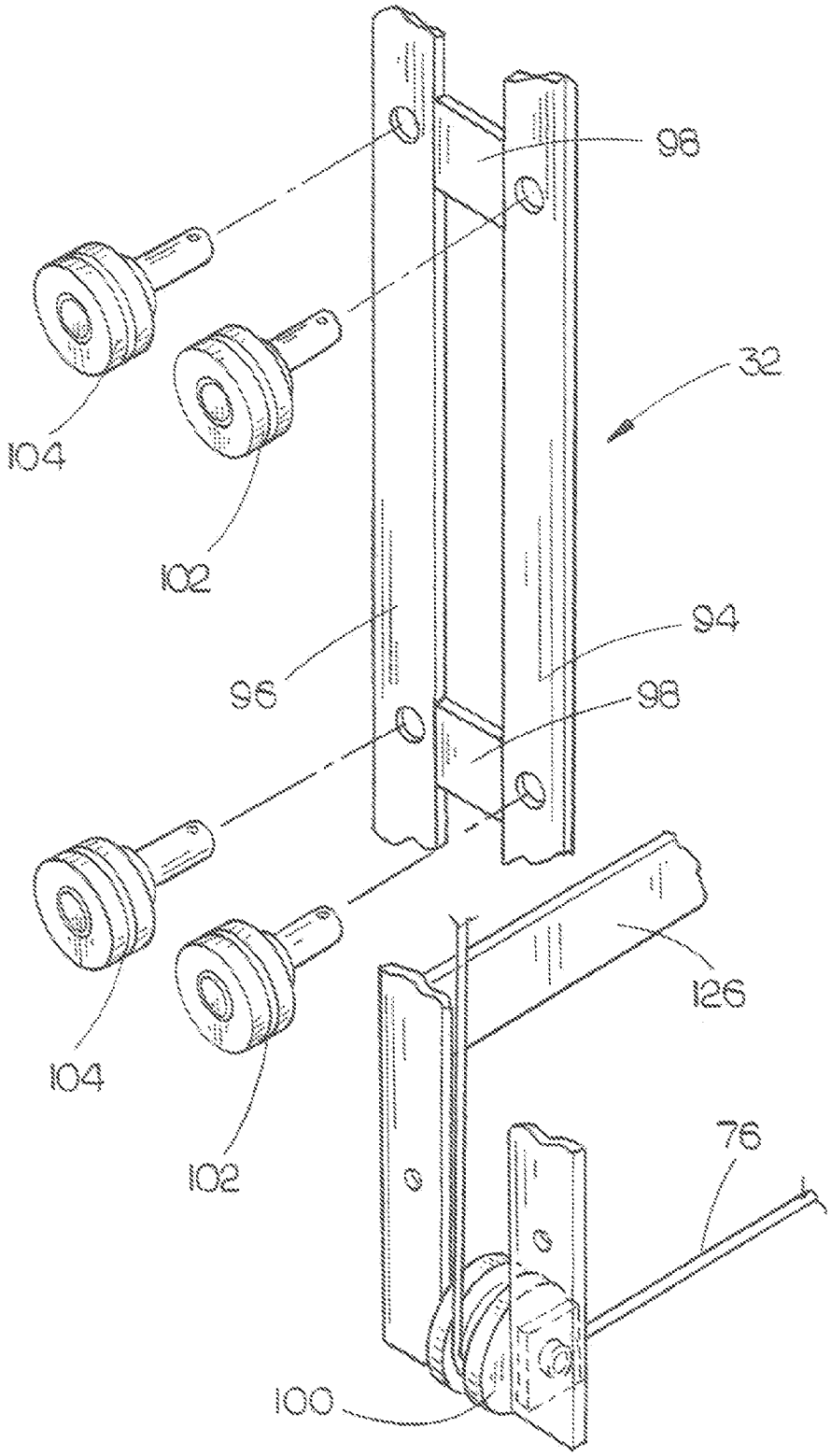
FIG. 4 is a partial exploded perspective view of a portion of the elevator assembly of this invention.

The numeral 86 refers to a step support assembly which is vertically movably mounted on side frames 34 and 50. Step support assembly 86 includes a first elongated step support member 88 having an upper end 90 and a lower end 92. Step support member 88 is vertically movably mounted within side frame 32 inwardly of the bars 46 and 48. As seen in FIGS. 2 and 3, step support member 88 is comprised of a pair of elongated bars or plates 94 and 96 which are spaced-apart from one another. A plurality of small plates 98 are secured to and extend between bars 94 and 96 to connect the bars 94 and 96. A rotatable sheave 100 is rotatably mounted on the lower end of step support member 88 as seen in FIG. 5 so as to partially extend between the bars 94 and 96 with the inner end of the sheave 100 being positioned inwardly of bars 94 and 96.

A plurality of vertically spaced-apart guide rollers 102 are secured to bar 94 so as to engage the inner surface of flange 44 (FIG. 5). A plurality of vertically spaced-apart guide rollers 104 are secured to bar 96 so as to engage at the inner surface of flange 42 (FIG. 5).

Step support assembly 86 also includes a second elongated step support member 106 having an upper end 108 and a lower end 110. Step support member 106 is vertically movably mounted within side frame 50, as seen in FIG. 5. As seen in FIG. 2, step support member 106 is comprised of a pair of elongated bars or plates 112 and 114 which are spaced-apart from one another. A plurality of small plates 116 are secured to and extend between bars 112 and 114 to connect the bars 112 and 114. A rotatable sheave 118 is rotatably mounted on the lower end of step support member 106 as seen in FIG. 3 so as to partially extend between the bars 112 and 114 with the inner end of the sheave 118 being positioned inwardly of bars 112 and 114.

A plurality of vertically spaced-apart guide rollers 120 are secured to bar 112 so as to engage the inner surface of flange 60 (FIG. 5). A plurality of vertically spaced-apart guide rollers 122 are secured to bar 114 so as to engage the inner surface of flange 58 (FIG. 5).

An elevator step 124 is secured to and extends between the lower ends of step support members 88 and 106 above the sheaves 100 and 118 respectively. A toe guard 126 is secured to bars 96 and 114 and extends therebetween above step 124 as seen in FIGS. 2 and 3.

Winch cable 76 extends downwardly from winch 74 through an opening 127 formed in the upper end of side frame 50 thence downwardly through the interior of side frame 50 between the guide rollers 120 and 124, thence around sheave 118, thence around sheave 100, thence upwardly through the interior of side frame 34 between the guide rollers 102 and 104 to the upper end of side frame 34. The free end of the cable 76 is secured to side frame 34 at 128.

The personnel elevator assembly 32 of this invention is used as follows. When the combine 10 is going to be used, the operator of the combine will grasp the controller 80 and operate the winch 74 so that the winch cable 76 will be played outwardly from the winch 74 until the elevator step 124 is lowered to a position on the ground or close to the ground. The operator then places his/her feet on the elevator step 124. The toe guard 126 prevents the operator from moving his/her feet too far inwardly to ensure that the operator's feet will not be pinched or injured by one of the steps 26 as the step support assembly 86 is moved upwardly.

The operator will then grasp one or both of the handles 70 and 72. The operator then operates the controller 80 and the winch 74 so that the winch 74 winds the winch cable 76 onto the winch 74 so that step support assembly 86 is moved upwardly with respect to the side frames 34 and 50 until the elevator step 124 is at the same level as the platform 20. The operator then deactivates the winch 74 and steps onto the platform 20. The operator will normally leave the elevator assembly 32 in the elevated position during the harvesting operation.

When the operator wishes to descend from the combine, the operator will step onto the elevator step 124 which is at the same level as platform 20. The operator then operates the controller 80 and the winch 74 to play out the winch cable 76 from the winch 74 until the elevator step 124 is at or near ground level. The operator can then easily step onto the ground.

Thus it can be seen that a personnel elevator has been provided which enables the operator of the combine to easily gain access to the elevated platform 20 and to easily lower himself/herself to the ground. Thus it can be seen that the invention accomplishes at least all of its stated objectives.

Although the invention has been described in language that is specific certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A personnel elevator assembly for accessing an elevated platform of a combine which has a ladder assembly, having a forward side, a rearward side, an inner side, an outer side, an upper end and a lower end, comprising:

a first upstanding side frame having upper and lower ends;

a second side frame having upper and lower ends;

said first and second side frames being horizontally spaced-apart from one another;

said first and second side frames being secured to the ladder assembly so as to be positioned laterally outwardly from said outer side of the ladder assembly;

a first substantially vertically disposed step support member having upper and lower ends, vertically movably mounted on said first side frame;

a second substantially vertically disposed step support member, having upper and lower ends, vertically movably mounted on said first side frame;

said first and second step support members being movable together between a lower position and an upper position;

a horizontally disposed elevator step secured to and extending between the lower ends of said first and second step support members for vertical movement therewith;

said horizontally disposed elevator step being positioned below the lower end of the ladder assembly when said first and second step support members are in said lower position;

said horizontally disposed elevator step being positioned at approximately the same level as the elevated platform of the combine when said first and second step support members are in said upper position;

and means for moving said first and second step support members between said lower and upper positions and for moving said first and second supports between said upper and lower positions.

2. The personnel elevator assembly of claim 1 wherein said means for moving said first and second step support members between said lower and upper positions and for moving said first and second step supports between said upper and lower positions comprises a winch.

3. The personnel elevator assembly of claim 2 wherein said winch includes a winch cable which is operatively connected to said first and second step support members.

4. The personnel elevator assembly of claim 1 wherein a supporting framework is secured to and extends between the ladder assembly and said first and second side frames.

5. The personnel elevator assembly of claim 4 wherein said means for moving said first and second step supports comprises a winch which is secured to said second side frame with the winch having a winch cable extending therefrom which is operatively connected to said first and second step support members.

6. The personnel elevator assembly of claim 2 wherein said winch is an electric winch having a controller which is positioned adjacent said first and second step support members whereby a person standing on said step is able to control said winch.

7. The personnel elevator assembly of claim 1 wherein a support railing is secured to said first side frame.

8. The personnel elevator assembly of claim 1 wherein a support railing is secured to said second side frame.

9. The elevator assembly of claim 7 wherein a support railing is also secured to said second side frame.

10. The personnel elevator assembly of claim 1 wherein a toe plate is secured to said first and second step support members and extends therebetween above said elevator step.

11. The personnel elevator assembly of claim 1 wherein said elevator step extends laterally outwardly from said first and second step support members.

12. The personnel elevator assembly of claim 1 wherein said first step support member has guide rollers secured thereto which are in engagement with said first side frame and wherein said second step support member has guide rollers secured thereto which are in engagement with said second side frame.

* * * * *